US007453421B2

(12) United States Patent
Kang et al.

(10) Patent No.: US 7,453,421 B2
(45) Date of Patent: Nov. 18, 2008

(54) PLASMA DISPLAY PANEL AND DRIVING METHOD THEREOF

(75) Inventors: Kyoung-Ho Kang, Suwon-si (KR); Woo-Joon Chung, Suwon-si (KR); Jin-Sung Kim, Suwon-si (KR); Seung-Hun Chae, Suwon-si (KR); Tae-Seong Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 756 days.

(21) Appl. No.: 10/975,053

(22) Filed: Oct. 28, 2004

(65) Prior Publication Data

US 2005/0156823 A1 Jul. 21, 2005

(30) Foreign Application Priority Data

Oct. 29, 2003 (KR) ..... 10-2003-0075946

(51) Int. Cl.
*G06G 3/28* (2006.01)

(52) U.S. Cl. ..... 345/60; 345/83; 345/67; 345/68; 345/690

(58) Field of Classification Search ..... 345/60, 345/63, 67–68, 690, 214
See application file for complete search history.

(56) References Cited

U.S. PATENT DOCUMENTS 7,212,177 B2 * 5/2007 Kanazawa et al. ..... 345/63
2006/0232514 A1 * 10/2006 Kubota et al. ..... 345/60

FOREIGN PATENT DOCUMENTS

JP 2003-050562 2/2003

* cited by examiner

*Primary Examiner*—Richard Hjerpe
*Assistant Examiner*—Leonid Shapiro
(74) *Attorney, Agent, or Firm*—H.C. Park & Associates, PLC

(57) ABSTRACT

Disclosed is a PDP driving method which may include generating subfield information that shows ON/OFF states of discharge cells from among a plurality of subfields from input image signals, generating address information that shows ON/OFF states of the discharge cells per subfield from the subfield data, counting the number of the discharge cells that are ON from among the discharge cells from the address data, and controlling a waveform applied during a reset period of a subsequent subfield.

21 Claims, 9 Drawing Sheets

PLASMA DISPLAY PANEL AND DRIVING METHOD THEREOF

CROSS REFERENCE TO RELATED APPLICATION

This application claims priority to and the benefit of Korea Patent Application No. 2003-75946 filed on Oct. 29, 2003, in the Korean Intellectual Property Office, the entirety of which is hereby incorporated by reference.

BACKGROUND OF THE INVENTION

1. Field of the Invention

The present invention relates to a PDP (plasma display panel) driving method. More specifically, the present invention relates to a PDP driving method for reducing a reset time.

2. Description of the Related Art

Recently, LCDs (liquid crystal displays), FEDs (field emission displays), and PDPs have been actively developed. PDPs have better luminance and light emission efficiency compared to the other types of flat panel devices, and also have wider view angles. Therefore, PDPs have come into the spotlight as substitutes for conventional CRTs (cathode ray tubes) in large displays of greater than 40 inches.

A PDP is a flat display that uses plasma generated via a gas discharge process to display characters or other images. Tens of thousands to millions of pixels may be provided thereon in a matrix format. The exact number of pixels depends on the size of the display. PDPs are either DC PDPs or AC PDPs.

Because DC PDPs have electrodes exposed in the discharge space, they allow electric current to flow in the discharge space while the voltage is supplied, and they therefore problematically require resistors for current restriction. On the other hand, because AC PDPs have electrodes covered by a dielectric layer, capacitances may naturally form to restrict the current, and the electrodes may be protected from ion shocks during discharge. Accordingly, AC PDPs have a longer lifespan than the DC PDPs.

FIG. 1 shows a perspective view of an AC PDP in general.

As shown in FIG. 1, a scan electrode 4 and a sustain electrode, disposed over a dielectric layer 2 and a protection film 3, may be provided in parallel and form a pair with each other under a first glass substrate 1. A plurality of address electrodes 8 covered with an insulation layer 7 may be provided on a second glass substrate 6. Barrier ribs 9 may be formed in parallel with the address electrodes 8 on the insulation layer 7 provided between the address electrodes 8. Also, phosphors 10 may be formed on the surface of the insulation layer 7 and on both sides of the barrier ribs 9. The first and second glass substrates 1 and 2 may be provided to face each other so that the scan electrodes 4 may cross the address electrodes 8 and the sustain electrodes 5 may cross the address electrodes 8 with discharge spaces 11 therebetween. Discharge spaces provided at crossing points of the address electrodes 8 and the scan electrodes 4 and the sustain electrodes 5 in pairs form discharge cells 12.

FIG. 2 shows a PDP electrode arrangement diagram.

As illustrated in FIG. 2, the PDP electrode has an (m×n) matrix configuration. Thus, m address electrodes A1 to Am may be arranged in the column direction. Correspondingly, n scan electrodes Y1 to Yn and sustain electrodes X1 to Xn may be alternately arranged in the row direction. For ease of discussion, the scan electrodes will be referred to as "Y electrodes" and the sustain electrodes as "X electrodes." The discharge cell 12 shown in FIG. 2 corresponds to the discharge cell 12 shown in FIG. 1.

FIG. 3 shows a conventional PDP driving waveform diagram. As illustrated, each subfield in the conventional PDP driving method has a reset period, an address period, and a sustain period.

The reset period includes an erase period, a Y ramp rising period, and a Y ramp falling period. The reset period erases wall charge states of a previous sustain discharge, and sets up the wall charges in order to perform a stable address discharge.

The address period selects cells which are turned on (ON) and are not turned on (OFF), and accumulates the wall charges at the ON cells (addressed cells.) The sustain period performs a discharge for actually displaying images on the addressed cells.

In this instance, the wall charges represent the charges which may be formed on the walls (e.g., a dielectric layer) of the discharge cells near the respective electrodes and accumulated at the electrodes. The wall charges may actually not contact the electrodes, but they may be described being "formed," "accumulated," or "piled" at the electrodes. Also, a wall voltage represents a potential difference formed on the wall of the discharge cells by the wall charges.

The accurate addressing operation may be generated during a subsequent address period in the conventional reset method by generating a reset discharge during the Y ramp rising period and the Y ramp falling period and controlling the quantity of the wall charges within the cell. In such a reset method, an accurate addressing operation is generated during the subsequent addressing period as a voltage difference between the Y electrode and the X electrode becomes greater during the reset period.

Because the wall charge states of the cells to which a sustain discharge has been generated and the cells to which no sustain discharge has been generated in the previous subfield may be different, the load may vary during the reset period of the subsequent subfield. That is, when a sustain discharge has been generated in the previous subfield to a large number of cells, sufficient priming particles and wall charges may accumulate in the discharge cells. Accordingly, the discharge firing voltage may be reduced in the subsequent subfield, and when a sustain discharge has been generated in the previous subfield to a small number of cells, priming particles and wall charges are rarely accumulated in the discharge cells, and hence, a discharge firing voltage is increased in the subsequent subfield.

In the conventional technique, reset pulses in the same format are necessarily applied to all the subfields during the reset period. As a result, the load variation in the reset period is not actively processed, and no stable reset operation is performed.

SUMMARY OF THE INVENTION

One advantage of the present invention may be to provide a device and method for driving a PDP for generating a reset waveform for preventing misfiring and realizing high-speed addressing.

The invention relates to a device in a PDP that displays light with varying intensities. In such a system it may be valuable to perform some intelligent reset operations rather than to apply the same result pulse in every subfield without regard to the non-ideal discharge cells in a PDP.

Accordingly, it may be appropriate to determine the number of cells that are in an ON state in each subfield. Based on some a priori information regarding the size and layout of the PDP, one may then determine whether the number of ON cells is enough to surpass a threshold.

If the number of ON cells surpasses the threshold, a number of modifications to the reset pulse may be made. The starting voltage of the rising waveform, for example, may decrease. Another modification that may be made is that the slope of the rising waveform may decrease (i.e. the rise time may increase). Yet another modification is that the fall time of the falling waveform may increase.

A threshold can also be used negatively, to trigger changes to the reset pulse when the number of ON cells does not exceed the threshold. It is even possible to include multiple thresholds and to modify the waveform of the reset pulse based on which thresholds have been (or not been) surpassed. In the extreme example, each marginal ON cell triggers a slight modification to the reset pulse.

In another embodiment, the relevant number of ON cells may be the number of cells within a segment of the PDP. This may be a particularly useful approach in especially large PDPs. The segment may correspond to physical boundaries of a manufactured component, or it may correspond to a group of cells located most proximate to the relevant cell. In a further embodiment of the present invention, the ON state of cells closest to the relevant cell would be weighted higher than those more distally located.

BRIEF DESCRIPTION OF THE DRAWINGS

The accompanying drawings are provided for illustrative and exemplary purposes. Together with the description, they serve to explain but not circumscribe the principles of the invention.

DETAILED DESCRIPTION OF THE EXEMPLARY EMBODIMENTS

Figure 1:
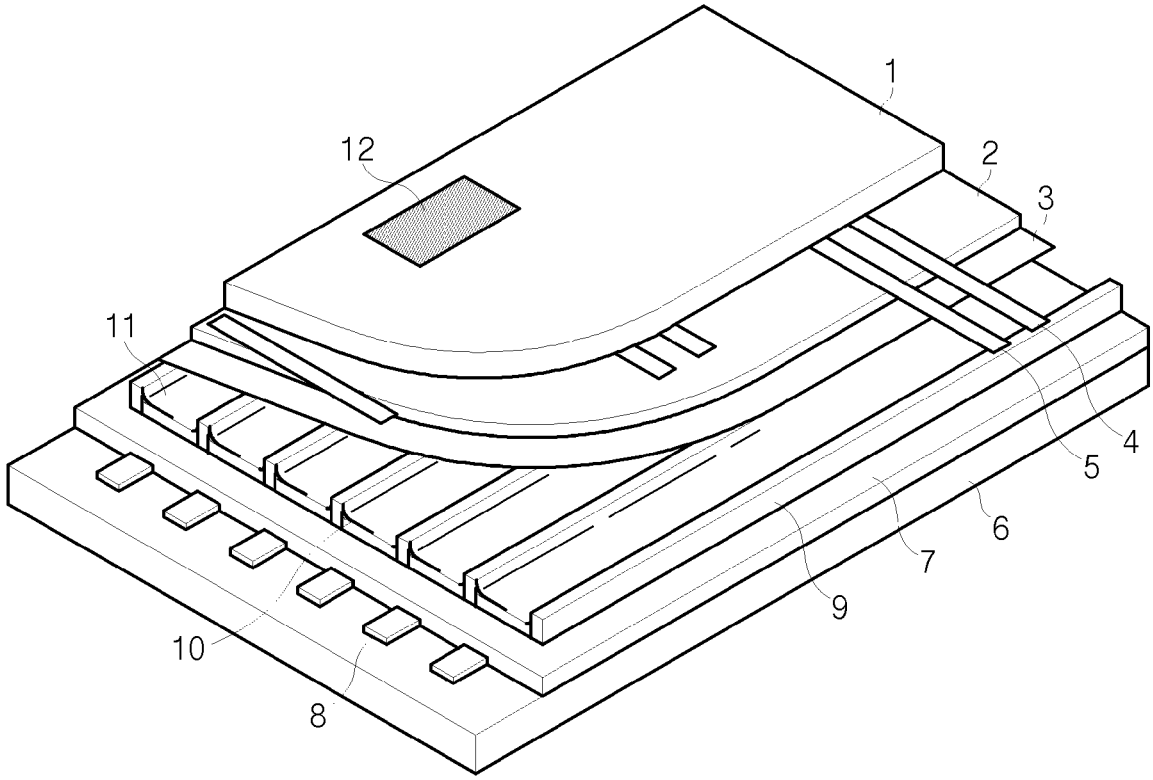
Fig. 1 (Prior Art)
FIG. 1 shows a perspective view of an AC PDP.
Figure 2:
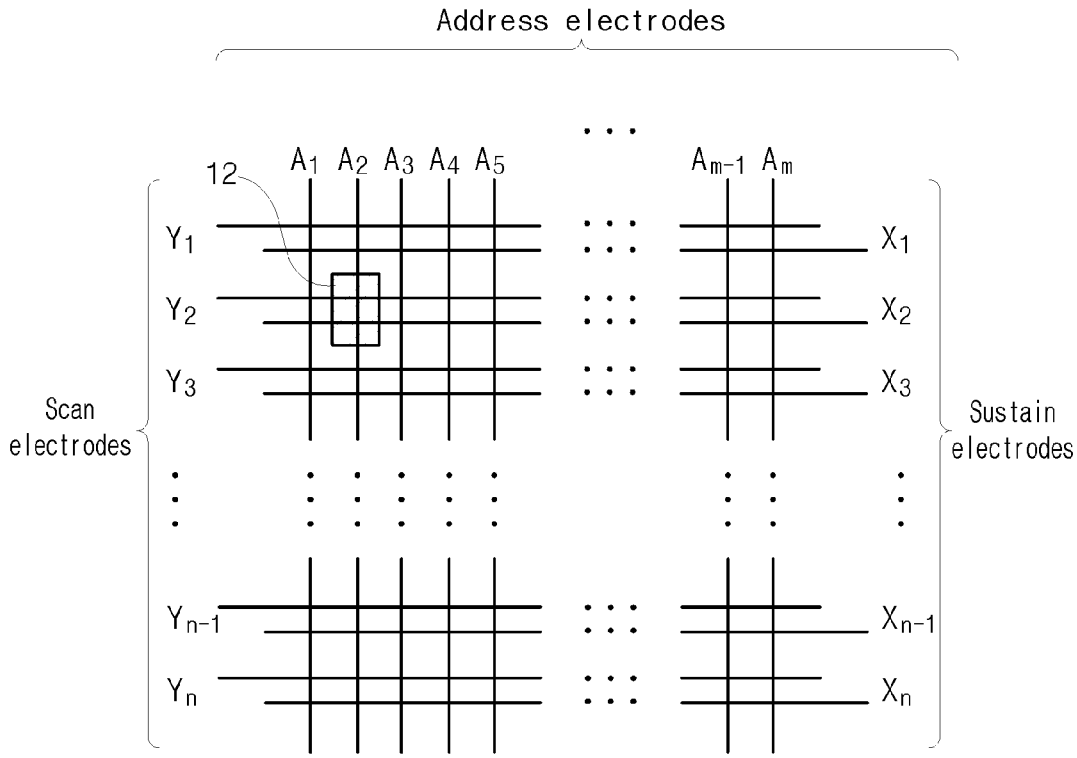
Fig. 2 (Prior Art)
FIG. 2 shows a PDP electrode arrangement diagram.
Figure 3:
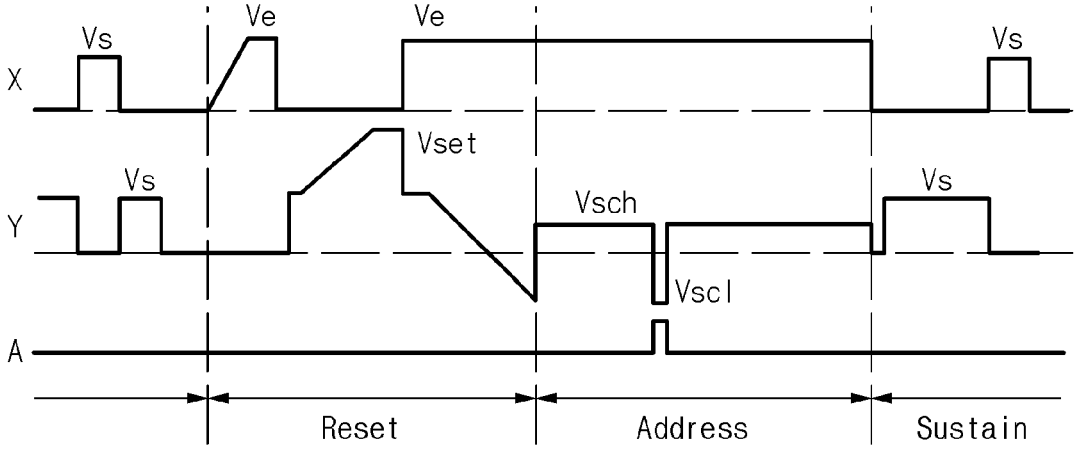
Fig. 3 (Prior Art)
FIG. 3 shows a conventional PDP driving waveform diagram.

The following detailed description is to explain and illustrate the invention. The invention may be modified in various respects without departing from the invention. To clarify the present invention, parts which are not described in the specification are omitted, and similar parts generally have the same reference numerals in the specification.

Figure 4A:
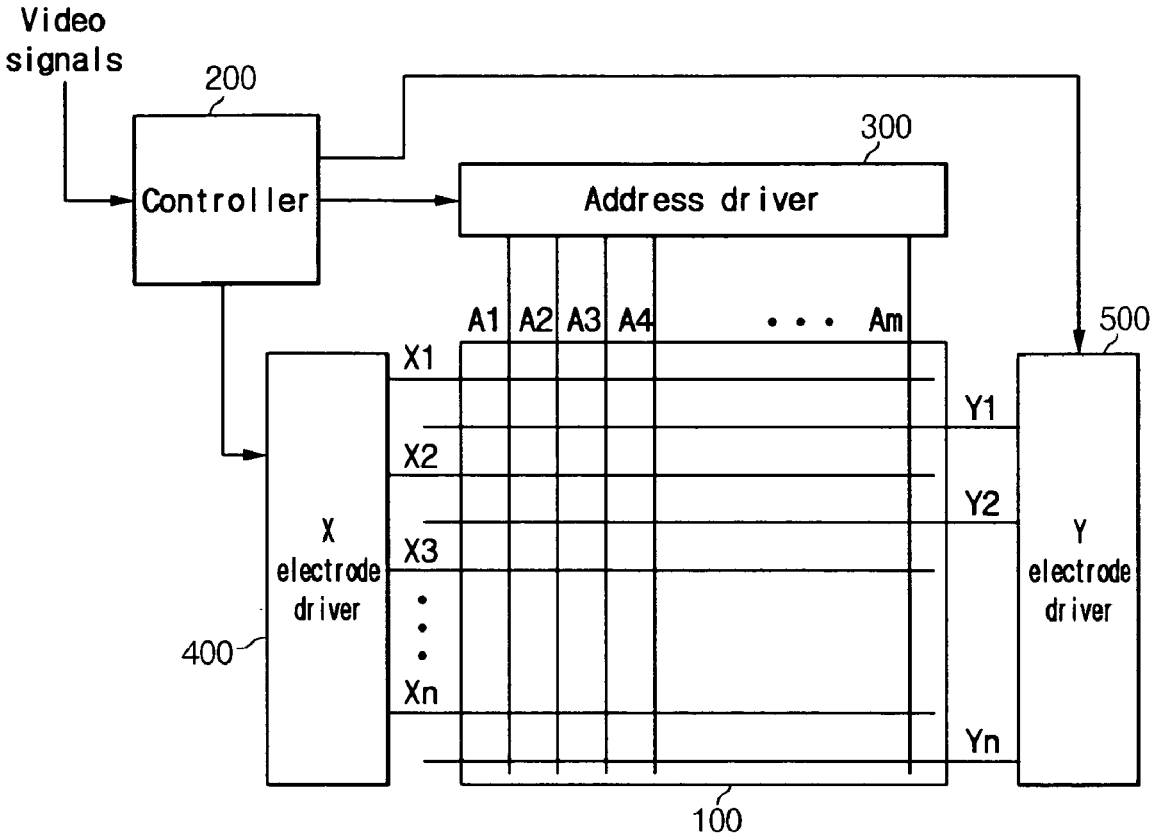
FIG. 4A shows a PDP configuration diagram according to an exemplary embodiment of the present invention.

FIG. 4A shows a PDP configuration diagram according to an exemplary embodiment of the present invention. As shown, the PDP includes a panel 100, a controller 200, an address driver 300, a sustain electrode driver (which will be referred to as an X electrode driver) 400, and a scan electrode driver (which will be referred to as a Y electrode driver) 500.

The panel 100 comprises a plurality of address electrodes A1 through Am arranged in the column direction, a plurality of sustain electrodes (X electrodes) X1 through Xn arranged in the row direction, and a plurality of scan electrodes (Y electrodes) Y1 through Yn arranged in the row direction. The X electrodes X1 through Xn may be formed corresponding to the respective Y electrodes Y1 through Yn, and their ends may be coupled in common. The panel 100 includes a glass substrate (not illustrated) on which the X and Y electrodes X1 through Xn and Y1 through Yn may be arranged, and a glass substrate (not illustrated) on which the address electrodes A1 through Am may be arranged. The two glass substrates face each other with a discharge space therebetween so that the Y electrodes Y1 through Yn may cross the address electrodes A1 through Am. It is also designed so that the X electrodes X1 through Xn may cross the address electrodes A1 through Am.

Accordingly, discharge spaces on the crossing points of the address electrodes A1 through Am and the X and Y electrodes X1 through Xn and Y1 through Yn form discharge cells.

The controller 200 externally receives video signals, and outputs address driving control signals, X electrode driving control signals, and Y electrode driving control signals. Also, the controller 200 divides a single frame into a plurality of subfields and drives them. Each subfield includes a reset period, an address period, and a sustain period with respect to temporal operation variations.

The address driver 300 receives address driving control signals from the controller 200, and applies display data signals for selecting desired discharge cells to the respective address electrodes A1 through Am. The X electrode driver 400 receives X electrode driving control signals from the controller 200 and applies driving voltages to the X electrodes X1 through Xn. The Y electrode driver 500 receives Y electrode driving control signals from the controller 200 and applies driving voltages to the Y electrodes Y1 through Yn.

Figure 4B:
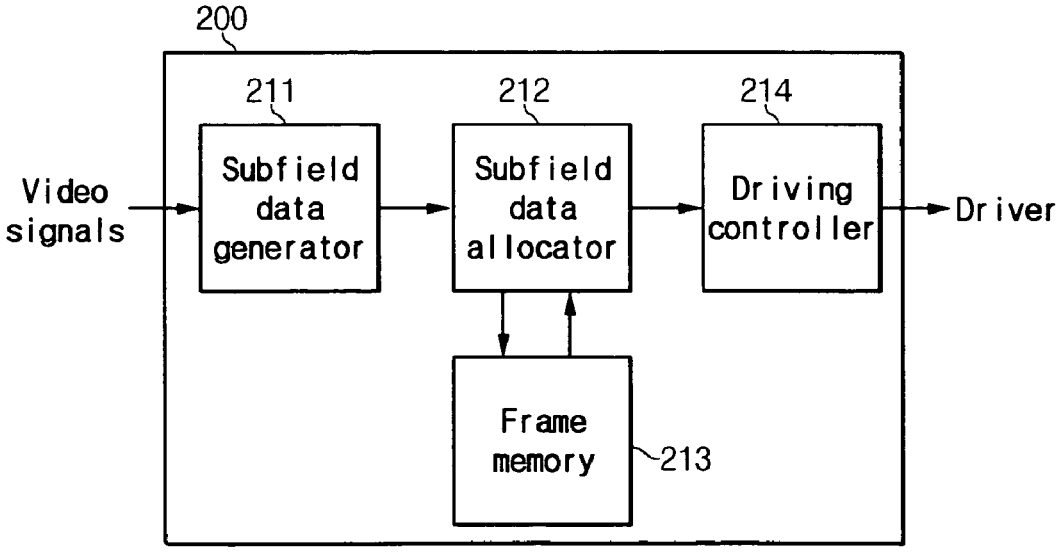
FIG. 4B shows a configuration of a PDP controller according to an exemplary embodiment of the present invention.

FIG. 4B shows an internal configuration of the controller 200 according to the exemplary embodiment of the present invention. As illustrated, the controller 200 of the PDP comprises a subfield data generator 211, a subfield data allocator 212, a frame memory 213, and is a driving controller 214.

The subfield data generator 211 generates subfield data for showing ON/OFF states of the discharge cells in a plurality of subfields from input image signals. The subfield data allocator 212 inputs the subfield data generated by the subfield data generator 211 into the frame memory 213 to allocate them to the respective discharge cells, and receives addressed data allocated per subfield from the frame memory 213. The driving controller 214 counts the number of the discharge cells which are ON in the respective subfields from the addressed data output by the subfield data allocator 212, and controls the reset waveform input to the next subfield so that the reset waveform may correspond to the number of the discharge cells.

Figure 5A:
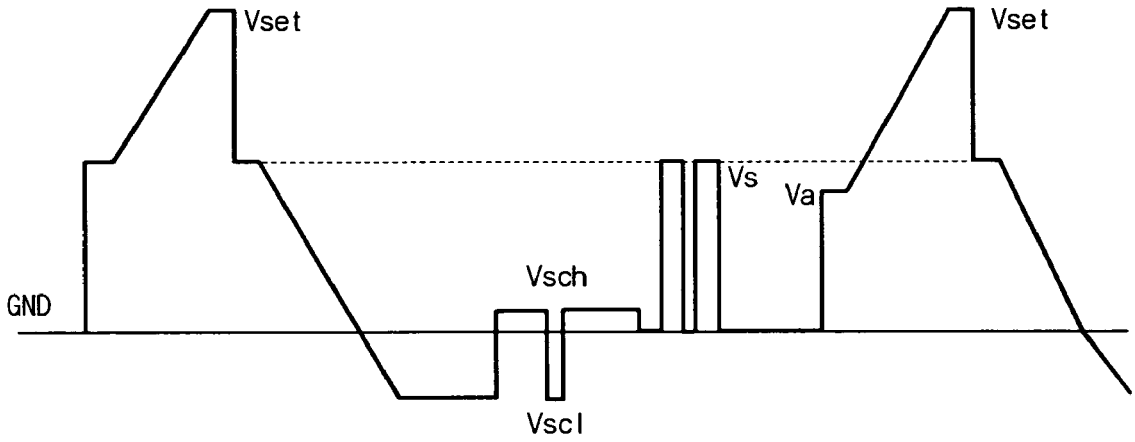
FIGS. 5A and 5B show Y electrode driving waveform diagrams of a PDP according to a first embodiment of the present invention.
Figure 5B:
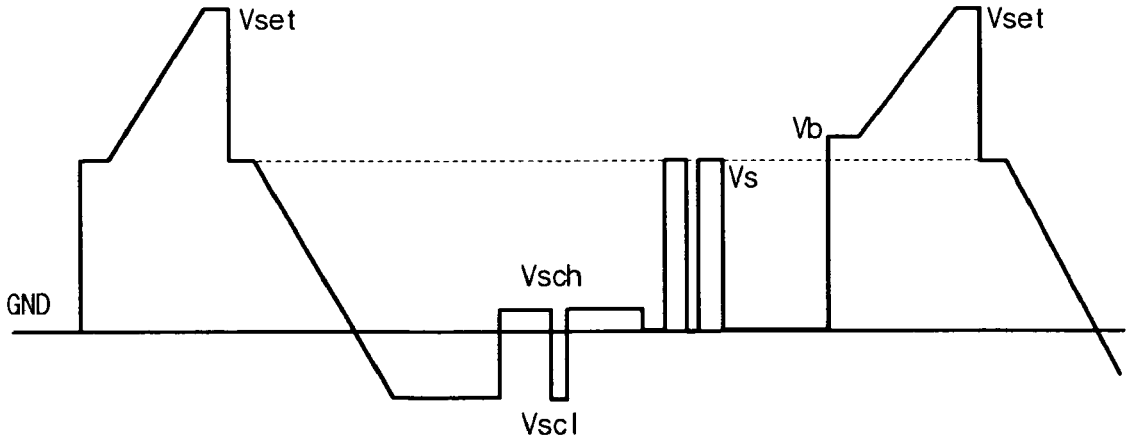

FIGS. 5A and 5B show Y electrode driving waveform diagrams according to a first exemplary embodiment of the present invention. When the number of the cells to which the sustain discharge has been generated in the previous subfield is greater than a reference value (when a weight is high), the discharge firing voltage may be lowered in the subsequent subfield because sufficient priming particles and the wall charges may be accumulated in the discharge cells. Hence, a strong discharge may be generated at a voltage of Vs for applying a rising ramp pulse during the reset period.

Therefore, the driving controller 214 controls the rising ramp pulse to be started at a voltage of Va which may be less than the sustain discharge voltage of Vs and prevent generation of the strong discharge during the reset period of the subfield after the subfield with a high weight, as shown in FIG. 5A. Thus, the gradient of the rising ramp pulse can be established to correspond to the gradient of the rising ramp pulse applied during the reset period of the first subfield.

Additionally, when the number of the cells to which the sustain discharge has been generated in the previous subfield is less than a reference value (when a weight is low), the discharge firing voltage may increase in the subsequent subfield. This is because insufficient priming particles and wall charges are accumulated in the discharge cells. Hence, no discharge may be generated for a predetermined time when the voltage is increased to greater than the voltage of Vs after the rising ramp pulse is applied during the reset period.

Therefore, the driving controller 214 controls the rising ramp pulse to start at a voltage of Vb which may be greater than the sustain discharge voltage of Vs during the reset period of the subfield in a subfield following a subfield with a low weight. Thus the reset period may be reduced as shown in FIG. 5B.

In this instance, the gradient of the rising ramp pulse can be established to correspond to the gradient of the rising ramp pulse applied during the reset period of the first subfield.

As described, generation of a strong discharge may be prevented, or the reset period may be reduced in the PDP driving method according to the first exemplary embodiment. This may be accomplished by allowing the driving controller 214 to control the start voltage of the rising ramp pulse according to the number of the cells to which the discharge has been generated in the previous subfield.

The start voltage of the rising ramp pulse may be controlled while the gradient of the rising ramp pulse may be maintained constantly in the first embodiment, and the gradient of the rising ramp pulse can also be modified.

Figure 6A:
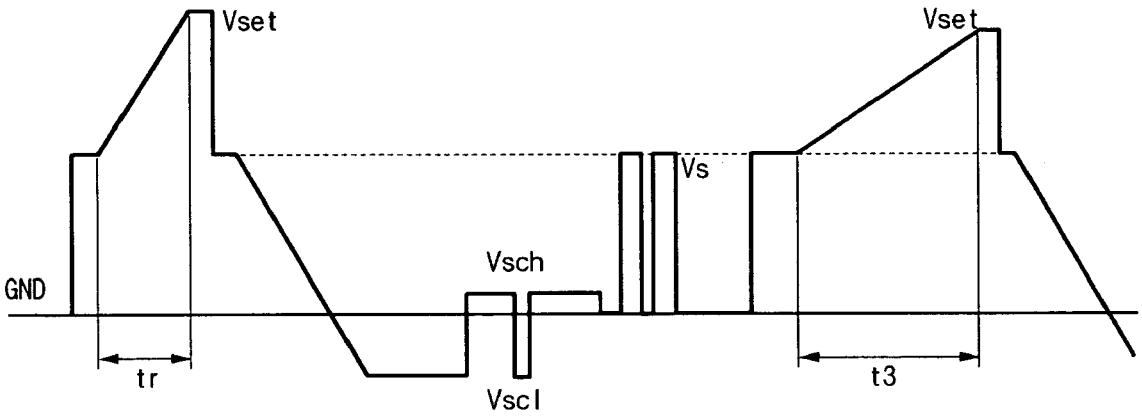
FIGS. 6A and 6B show Y electrode driving waveform diagrams of a PDP according to a second embodiment of the present invention.
Figure 6B:
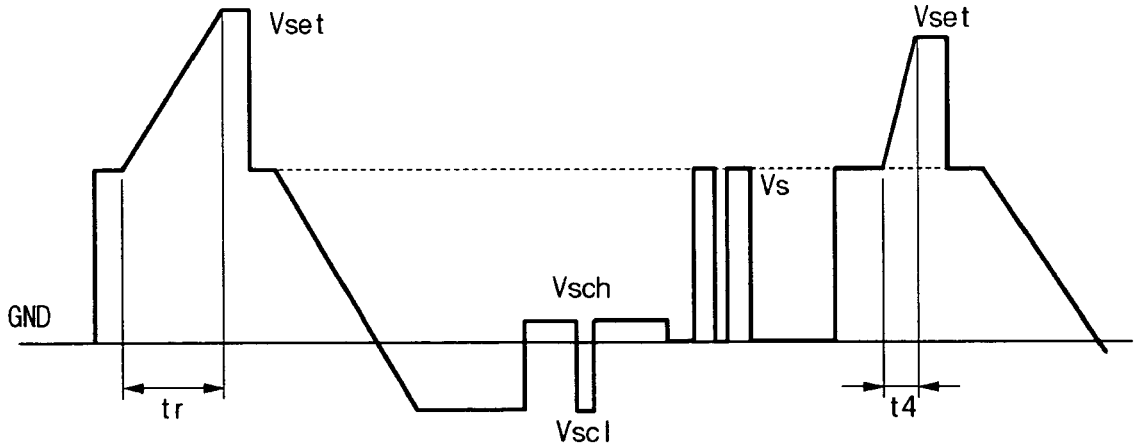

FIGS. 6A and 6B show Y electrode driving waveform diagrams of a PDP according to a second exemplary embodiment of the present invention.

Because the subfield after the subfield with a high weight has a low discharge firing voltage, a strong discharge may be generated during the reset period. Hence, the driving controller 214 may allow the gradient of the rising ramp pulse to be less than the gradient of the rising ramp pulse applied during the reset period of the first subfield, and may gradually increase the voltage to prevent generation of a strong discharge as shown in FIG. 6A. Consequently, the time t3 for applying the rising ramp pulse will be longer than the time tr for applying the rising ramp pulse in the first subfield, under these conditions.

Also, as shown in FIG. 6B, the gradient of the rising ramp pulse during the reset period of the subfield having a smaller probability of generating a misfiring discharge due to a high discharge firing voltage is set to be greater than the gradient of the rising ramp pulse applied during the reset period of the first subfield. Thus, the reset time may accordingly be reduced, as the time t4 for applying the rising ramp pulse becomes shorter than the time tr for applying the rising ramp pulse in the first subfield.

The invention is also applicable in cases in which the subfield uses a sustain discharge pulse and not a rising ramp pulse if it uses a falling ramp pulse during the reset period.

Figure 7A:
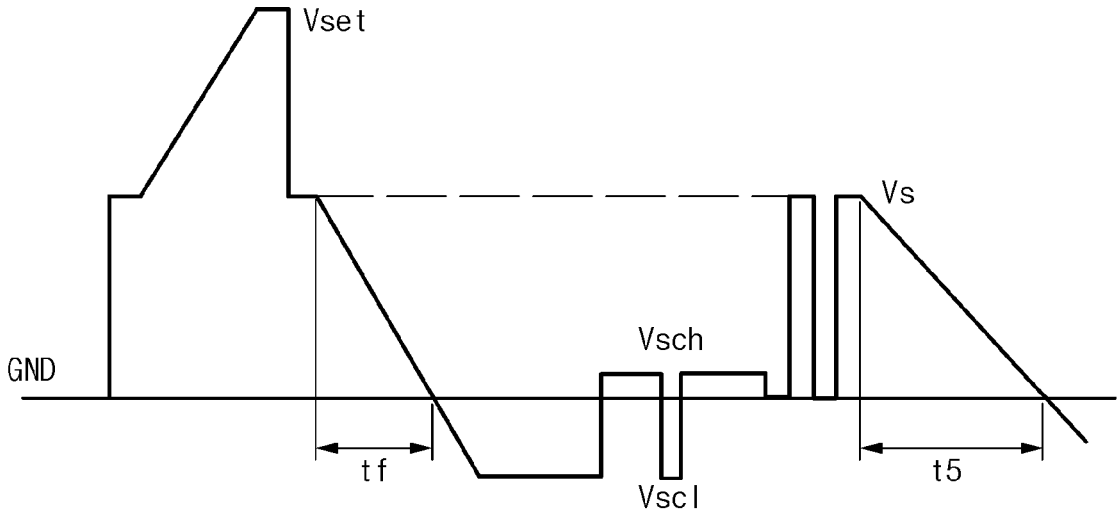
FIGS. 7A and 7B show Y electrode driving waveform diagrams of a PDP according to a third embodiment of the present invention.

As shown in FIG. 7A, the absolute value of the gradient of the falling ramp pulse may be established to be less than the absolute value of the gradient of the falling ramp pulse applied during the reset period of the first subfield. The voltage may be gradually reduced so that no misfiring discharge occurs during the reset period of the subfield after a subfield with a high weight. Therefore, the time t5 for applying the falling ramp may be longer than the time tf for applying the falling ramp in the first subfield.

Figure 7B:
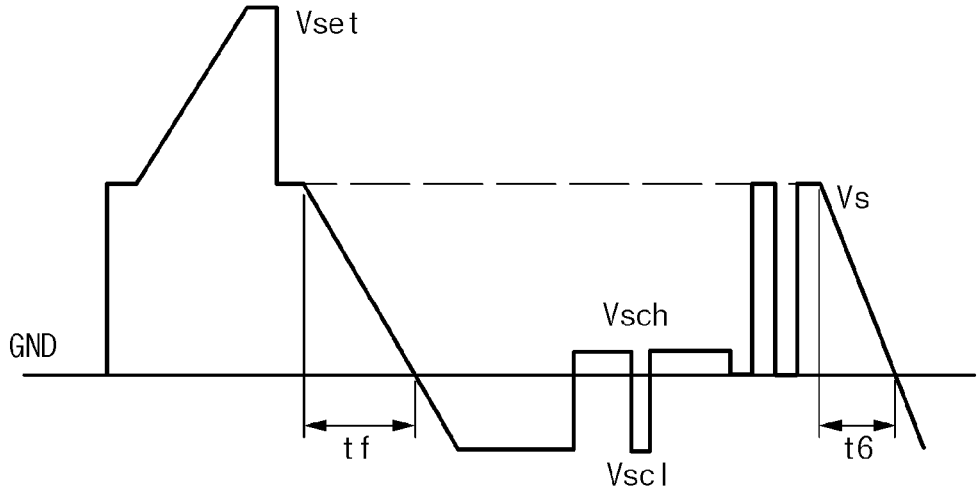

As shown in FIG. 7B, the absolute value of the gradient of the falling ramp pulse may be established to be greater than the absolute value of the gradient of the falling ramp pulse applied during the reset period of the first subfield. Thus the voltage may be allowed to gradually reduce, thereby avoiding misfiring discharge during the reset period of a subfield with less generation probability of a misfiring discharge (a subfield after a subfield with a low weight). Therefore, because the time t6 for applying the falling ramp becomes shorter than the time tf for applying the falling ramp in the first subfield, the reset time is reduced.

Figure 8A:
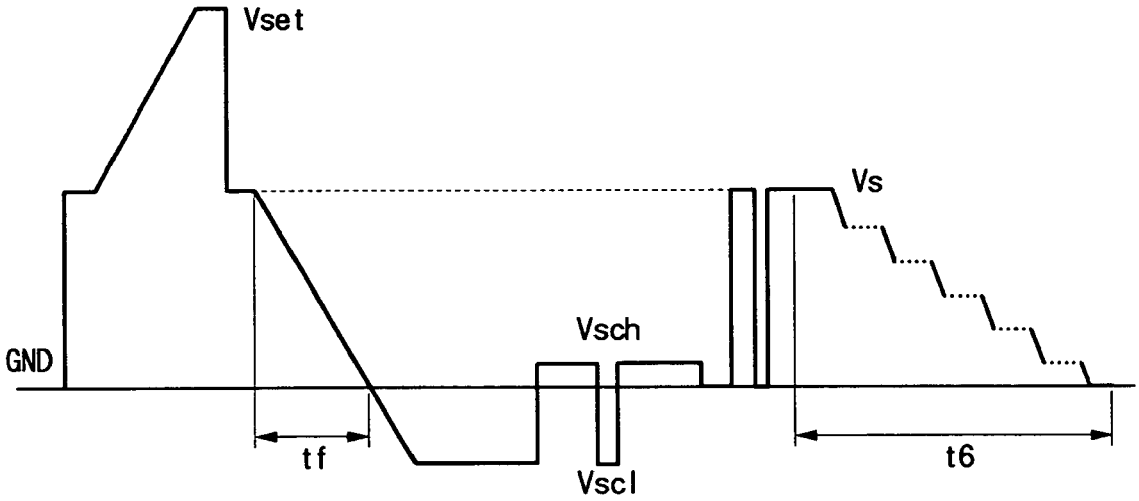
FIGS. 8A and 8B show Y electrode driving waveform diagrams of a PDP according to a fourth embodiment of the present invention.
Figure 8B:
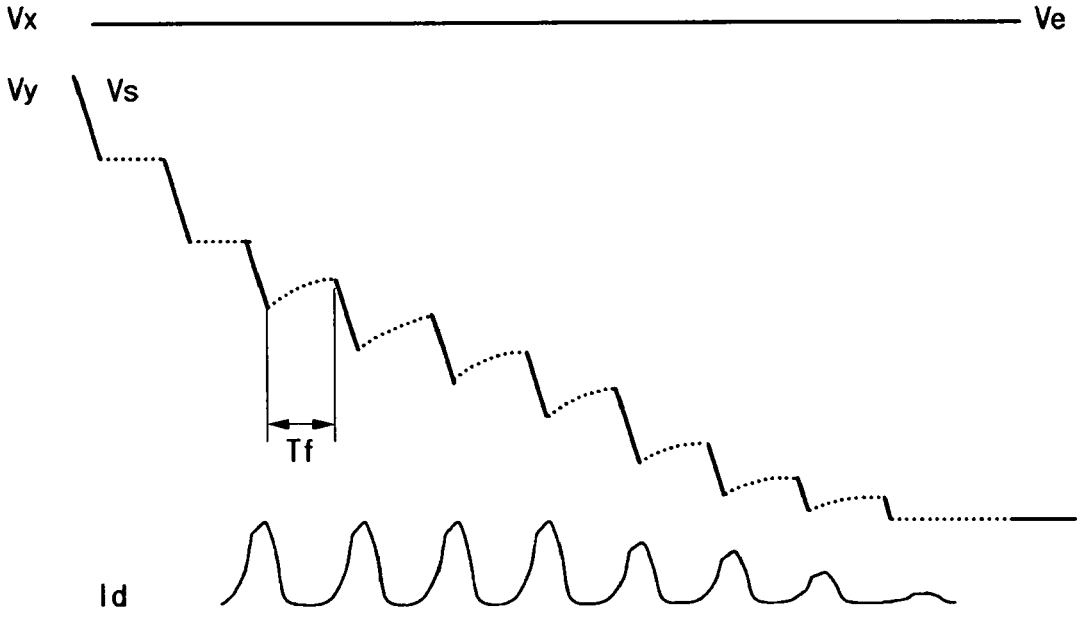

FIGS. 8A and 8B show Y electrode driving waveform diagrams of a PDP according to a fourth exemplary embodiment of the present invention.

As shown in FIGS. 8A and 8B, while the voltage at the X electrode is fixed to be Ve during the reset period according to the fourth embodiment, the voltage applied to the Y electrode may be reduced by a predetermined amount. Meanwhile the voltage supplied to the Y electrode during the period of Tf may be intercepted to float the Y electrode. The operation of reducing the voltage at the Y electrode by a predetermined amount and floating the Y electrode for a predetermined time Tf may be repeated.

When the voltage difference between the voltage of Vx at the X electrode and the voltage of Vy at the Y electrode becomes greater than the discharge firing voltage Vf while the operation is being repeated, a discharge may occur between the X and Y electrodes. That is, a discharge current Id flows in the discharge space. When the Y electrode is floated after the start of a discharge between the X and Y electrodes, the voltage at the Y electrode may be varied according to the amount of the wall charges. This is because there may be no charges supplied from an external power source. Therefore, the varied amount of the wall charges directly reduces the voltage within the discharge space, and the discharge may be quenched with a small amount of varied wall charges. That is, the wall charges formed at the X and Y electrodes may be reduced, the voltage within the discharge space may be steeply reduced, and a strong discharge quenching may be generated in the discharge space. When the Y electrode is floated after a discharge is formed by reducing the voltage at the Y electrode, the wall charges may be reduced, and a strong discharge quenching may be concurrently generated in the discharge space as described above. When the operation for reducing the voltage at the Y electrode and floating the Y electrode is repeated for a predetermined number of times, a desired amount of wall charges may be formed at the X and Y electrodes. Accordingly, wall charges can be finely controlled because discharge may be quenched with a small amount of varied wall charges.

Strong discharge may also be quenched by floating. Thus it may be possible to steeply reduce the voltage at the Y electrode during the reset period of the subfield (the subfield after the subfield with a lesser weight) with a lower probability of misfiring discharge.

That is, the floating time may be lengthened during the reset period of a subfield with a high weight so that the time for applying the falling waveform may be made greater than the time for applying the falling waveform in the first subfield, and the floating time may be shortened during the reset period of the subfield with a low weight so that the time for applying the falling waveform may be less than the time for applying the falling waveform in the first subfield.

Because a strong discharge may occur when the time for applying the voltage to the Y electrode is long, it may be desirable for the time for applying the voltage to the Y electrode and the time for reducing the voltage at the Y electrode to be less than the time for floating the Y electrode.

Also, the time for applying the falling waveform can be controlled by controlling the magnitude of the voltage reduced when the falling waveform is applied. That is, the width for reducing the voltage of the falling waveform may be narrowed during the reset period of a subfield with a high weight. Thus the time for applying the falling waveform may be greater than the time for applying the falling waveform in the first subfield. Additionally, the width for reducing the voltage of the falling waveform may be widened during the reset period of a subfield with a low weight, and thus the time for applying the falling waveform may be less than the time for applying the falling waveform in the first subfield.

Figure 9A:
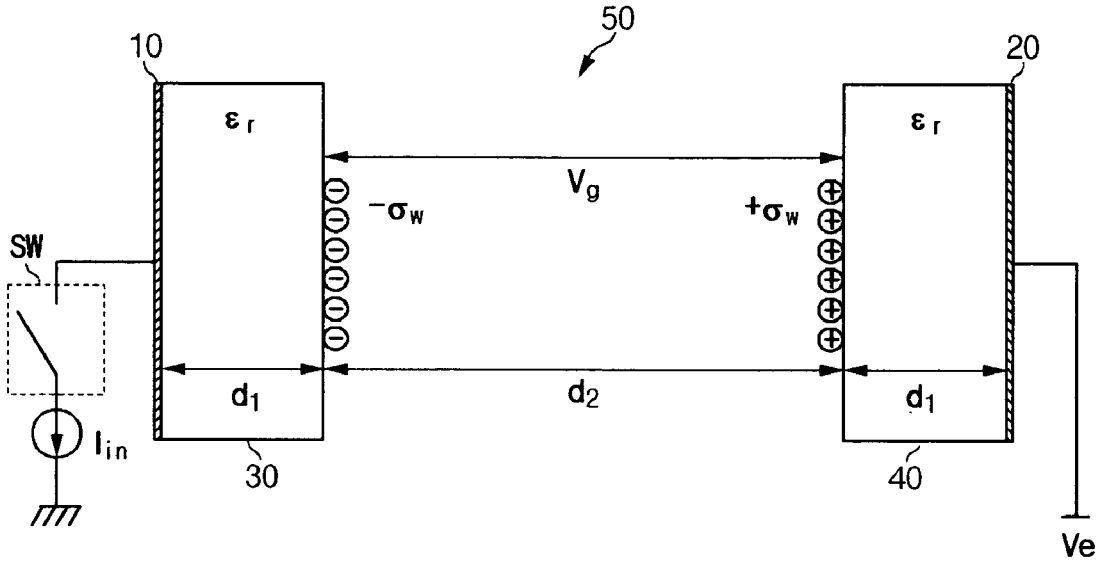
FIG. 9A shows a modeled diagram of discharge cells formed by the X and Y electrodes.
Figure 9B:
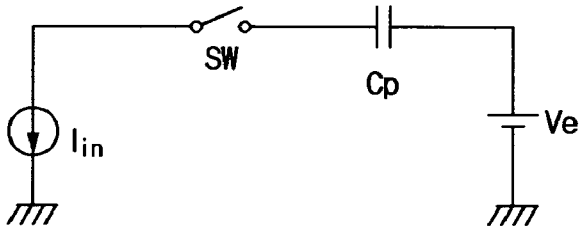
FIG. 9B shows an equivalent circuit diagram of FIG. 9A.
Figure 9C:
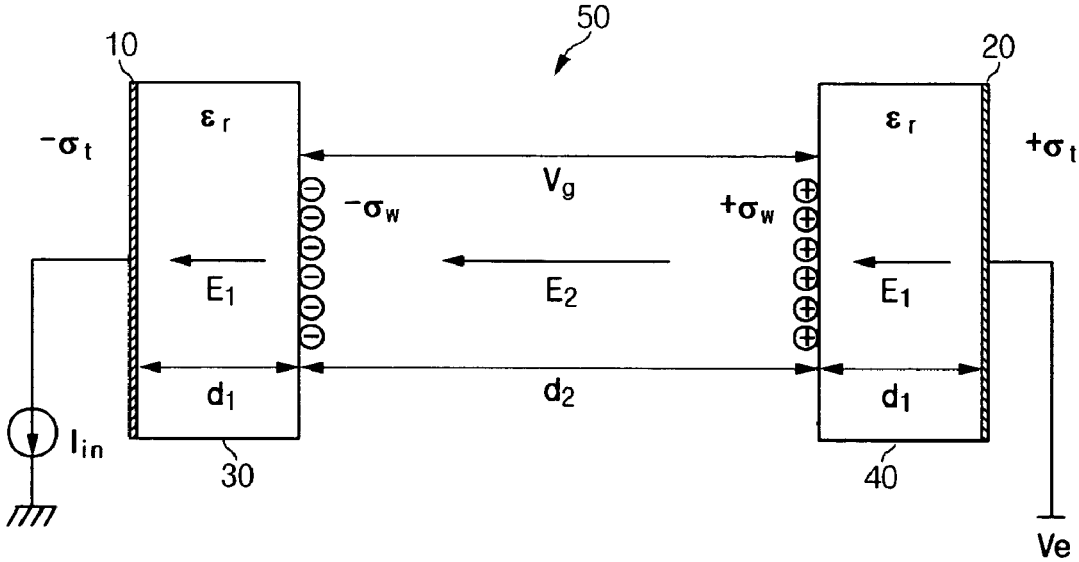
FIG. 9C shows that no discharge may be generated in the discharge cells of FIG. 9A.
Figure 9D:
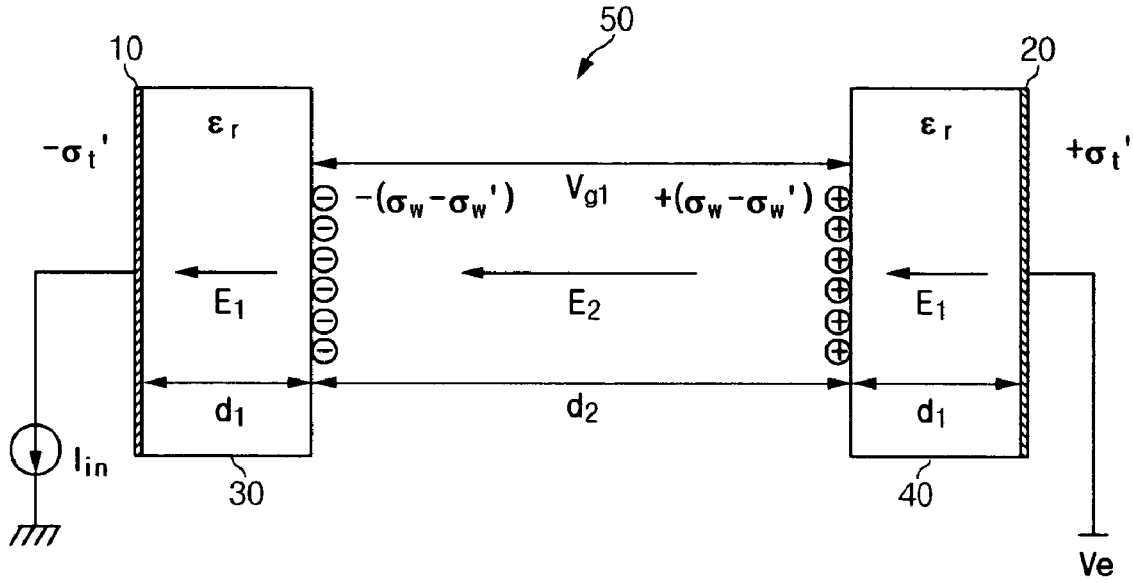
FIG. 9D shows a state in which a voltage may be applied when a discharge is generated in the discharge cells of FIG. 9A.
Figure 9E:
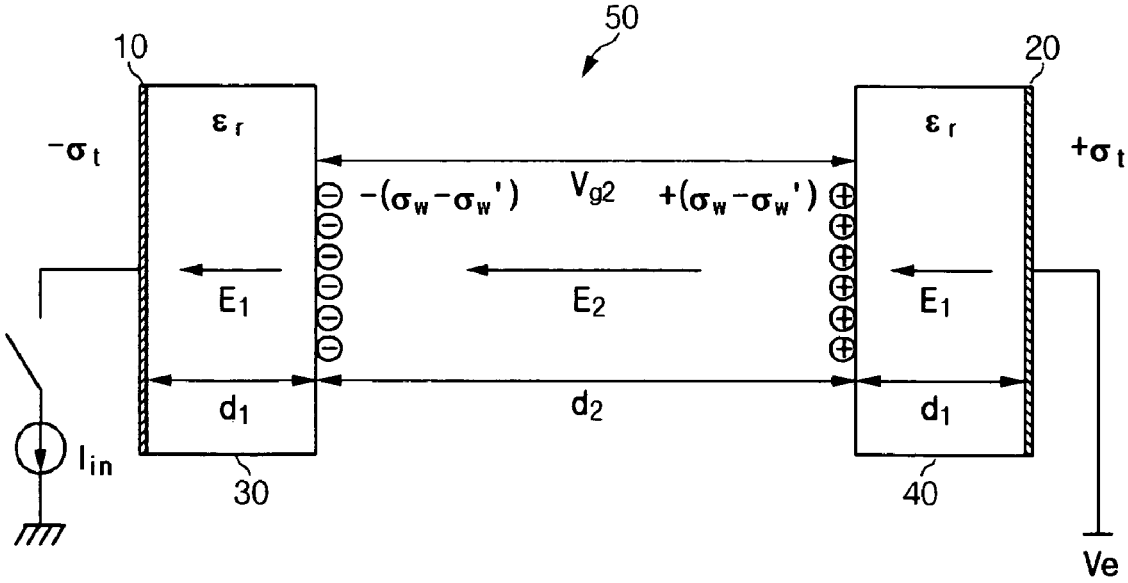
FIG. 9E shows a floated state when a discharge may be generated in the discharge cells of FIG. 9A.

FIG. 9A shows a stylized diagram of a discharge cell formed by a sustain electrode and a scan electrode. FIG. 9B shows an equivalent circuit of FIG. 9A. FIG. 9C shows a case in which no discharge occurs in the discharge cell of FIG. 9A. FIG. 9D shows a state in which a voltage may be applied when a discharge occurs in the discharge cell of FIG. 9A. FIG. 9E shows a floated state when a discharge occurs in the discharge cell of FIG. 9A. For ease of description, charges $-\sigma_w$ and $+\sigma_w$ should be taken to correspond to the charges respectively formed at the Y and X electrodes 10 and 20 in an earlier stage in FIG. 9A. The charges may actually be formed on a dielectric layer of an electrode, but, for ease of explanation, they are described as being formed at the electrode.

As shown in FIG. 9A, the Y electrode 10 may be coupled to a current source Iin through a switch. The X electrode 20 may be coupled to voltage source Ve. Dielectric layers 30 and 40 may be respectively formed within the Y and X electrodes 10 and 20. Discharge gas (not illustrated) may be injected between the dielectric layers 30 and 40, and the area provided between the dielectric layers 30 and 40 may form a discharge space 50.

Thus, because the Y and X electrodes 10 and 20, the dielectric layers 30 and 40, and the discharge space 50 form a capacitive load, they have been represented by a panel capacitor Cp as shown in FIG. 9B. The dielectric constant of the dielectric layers 30 and 40 is defined as $\epsilon_r$. A voltage at the discharge space 50 is Vg. The thickness of the dielectric layers 30 and 40 is d1. Finally, the distance (the extent of the discharge space) between the dielectric layers 30 and 40 is d2.

The voltage of Vy applied to the Y electrode of the panel capacitor Cp may be reduced in proportion to the time when the switch SW may be ON, as given in Equation 1. Thus, when the switch SW is ON, the voltage at the Y electrode 10 may be reduced. The voltage at the Y electrode 10 may be reduced by using the current source in FIGS. 9A to 9E. The reduced voltage can be directly applied to the Y electrode 10, and the voltage at the Y electrode 10 can be reduced by discharging the panel capacitor.

$$Vy = Vy(0) - \frac{I_{in}}{C_p}t \qquad \text{Equation 1}$$

where Vy(0) is a Y electrode voltage Vy when the switch SW is ON, and Cp is capacitance of the panel capacitance Cp.

As shown in FIG. 9C, the voltage Vg applied to the discharge space 50 when no discharge occurs while the switch SW is ON may be calculated, assuming that the voltage applied to the Y electrode 10 is Vin.

When the voltage of Vin is applied to the Y electrode 10, the charges $-\sigma_t$ may be applied to the Y electrode 10, and the charges $+\sigma_t$ may be applied to the X electrode 20. By applying the Gaussian theorem, the electric field E1 within the dielectric layers 30 and 40 and the electric field E2 within the discharge space 50 may be given as Equations 2 and 3.

$$E_1 = \frac{\sigma_t}{\varepsilon_r \varepsilon_0} \qquad \text{Equation 2}$$

where $\sigma_t$ is charges applied to the Y and X electrodes, and $\epsilon_0$ is a permittivity within the discharge space.

$$E_2 = \frac{\sigma_t + \sigma_w}{\varepsilon_0} \qquad \text{Equation 3}$$

The voltage of (Ve−Vy) applied outside may be given as Equation 4 according to a relation between the electric field and the distance, and the voltage of Vg of the discharge space 50 may be given as Equation 5.

$$2d_1E_1 + d_2E_2 = V_e - V_{in} \qquad \text{Equation 4}$$

$$V_g = d_2E_2 \qquad \text{Equation 5}$$

From Equations 2 through 5, the charges $\sigma_t$ applied to the X or Y electrode 10 or 20 and the voltage Vg within the discharge space 50 may be respectively given as Equations 6 and 7.

$$\sigma_t = \frac{V_e - V_{in} - \frac{d_2}{\varepsilon_0}\sigma_w}{\frac{d_2}{\varepsilon_0} + \frac{2d_1}{\varepsilon_r \varepsilon_0}} = \frac{V_e - V_{in} - V_w}{\frac{d_2}{\varepsilon_0} + \frac{2d_1}{\varepsilon_r \varepsilon_0}} \qquad \text{Equation 6}$$

where Vw is a voltage formed by the wall charges $\sigma_w$ in the discharge space 50.

$$V_g = \frac{\varepsilon_r d_2}{\varepsilon_r d_2 + 2d_1}(V_e - V_{in} - V_w) + V_w = \alpha(V_e - V_{in}) + (1 - \alpha)V_w \qquad \text{Equation 7}$$

Actually, because the internal length d2 within the discharge space 50 may be a very large value compared to the thickness d1 of the dielectric layers 30 and 40, $\alpha$ almost reaches 1. That is, Equation 7 shows that the externally applied voltage of (Ve−Vin) is applied to the discharge space 50.

Next, as shown in FIG. 9D, the voltage Vg1 within the discharge space 50 when the wall charges formed at the Y and X electrodes 10 and 20 may be quenched by the amount of $\sigma_w'$. This may be a predictable amount because the discharge caused by the externally applied voltage of (Ve−Vin) may be calculated. The charges applied to the Y and X electrodes 10 and 20 may increase to $\sigma_t'$. This increase may occur because charges are supplied from voltage source Vin so as to maintain the potential of the electrodes when the wall charges are formed.

By applying the Gaussian theorem in FIG. 9D, the electric field E1 within the dielectric layers 30 and 40 and the electric field E2 within the discharge space 50 may be given as Equations 8 and 9.

$$E_1 = \frac{\sigma_t'}{\varepsilon_r \varepsilon_0} \quad \text{Equation 8}$$

$$E_2 = \frac{\sigma_t' + \sigma_w - \sigma_w'}{\varepsilon_0} \quad \text{Equation 9}$$

From Equations 8 and 9, the charges $\sigma_t'$ applied to the Y and X electrodes 10 and 20 and the voltage Vg1 within the discharge space may be given as Equations 10 and 11.

$$\sigma_t' = \frac{V_e - V_{in} - \frac{d_2}{\varepsilon_0}(\sigma_w - \sigma_w')}{\frac{d_2}{\varepsilon_0} + \frac{2d_1}{\varepsilon_r \varepsilon_0}} = \frac{V_e - V_{in} - V_w + \frac{d_2}{\varepsilon_0}\sigma_w'}{\frac{d_2}{\varepsilon_0} + \frac{2d_1}{\varepsilon_r \varepsilon_0}} \quad \text{Equation 10}$$

$$V_{g1} = d_2 E_2 = \alpha(V_e - V_{in}) + (1-\alpha)V_w - (1-\alpha)\frac{d_2}{\varepsilon_0}\sigma_w' \quad \text{Equation 11}$$

Because $\alpha$ is almost 1 in Equation 11, very little voltage drop-off may be generated within the discharge space 50 when voltage Vin is externally applied to generate a discharge. Therefore when the amount $\sigma_w'$ of the wall charges quenched by the discharge is very large, the voltage Vg1 within the discharge space 50 may be reduced, and the discharge may be quenched.

Next, as shown in FIG. 9E, the voltage Vg2 within the discharge space 50 when the switch SW is turned OFF (e.g., the discharge space 50 is floated) after the wall charges formed at the Y and X electrodes 10 and 20 may be quenched by the amount of $\sigma_w'$. Accordingly, the discharge caused by the externally applied voltage Vin may be calculated. Because no external charges may be applied, the charges applied to the Y and X electrodes 10 and 20 become $\sigma_t$ in the same manner of FIG. 9C. By applying the Gaussian theorem, the electric field E1 within the dielectric layers 30 and 40 and the electric field E2 within the discharge space 50 may be given as Equation 2 and 12.

$$E_2 = \frac{\sigma_t + \sigma_w - \sigma_w'}{\varepsilon_0} \quad \text{Equation 12}$$

From Equations 12 and 6, the voltage Vg2 of the discharge space 50 may be given as Equation 13.

$$V_{g2} = d_2 E_2 = \alpha(V_e - V_{in}) + (1-\alpha)V_w - \frac{d_2}{\varepsilon_0}\sigma_w' \quad \text{Equation 13}$$

It is known from Equation 13 that large voltage falling may be generated by the quenched wall charges when the switch SW is turned OFF (floated). That is, as shown in Equations 12 and 13, the voltage falling intensity caused by the wall charges in the floated state of the electrode becomes larger by a multiple of $1/(1-\alpha)$ times that of the voltage applied state. As a result, because the voltage within the discharge space 50 may be substantially reduced in the floated state when a small amount of charges are quenched, the voltage between the electrodes becomes less than the discharge firing voltage. Consequently, the discharge may be steeply quenched. That is, floating the electrode after discharge starts, functions as a steep discharge quenching mechanism. When the voltage within the discharge space 50 is reduced, the voltage Vy at the floated Y electrode may increase by a predetermined voltage as shown in FIG. 8B. This may be accomplished by fixing the X electrode at the voltage of Ve.

As shown in FIG. 8B, when the Y electrode is floated and the Y electrode voltage drop-off causes a discharge, the discharge may be quenched. Meanwhile the wall charges formed at the Y and X electrodes may be slightly quenched according to the discharge quenching mechanism. By repeating this operation, the wall charges formed at the Y and X electrodes may be erased step by step. This step by step mechanism may permit fine tuning of the wall charges to a desired state. That is, the wall charges may be accurately controlled to achieve a desired wall charge state in the falling ramp period of the reset period.

The fourth embodiment is described during the falling ramp period of the reset period, but may be used in other circumstances. For example, the steep quenching mechanism may be applicable to cases of controlling the wall charges by using the rising ramp waveform. That is, it may be possible to repeatedly increase the voltage at the electrode by a predetermined amount and float the electrode. This may be an alternative to applying a rising ramp voltage to the X or Y electrode.

While this invention has been described in connection with what is presently considered to be the most practical and exemplary embodiment, it should be understood that the invention is not limited to the disclosed embodiments. On the contrary, it includes various modifications and equivalent arrangements included within the spirit and scope of the appended claims.

For example, the initial voltage of the rising ramp pulse is controlled in the first exemplary embodiment, the gradient of the rising ramp pulse is controlled in the second exemplary embodiment, and the initial voltage and the gradient of the rising ramp pulse can be controlled at the same time. Generation of a misfiring discharge can be prevented during the reset period by allowing a different gradient and discharge firing voltage of the reset ramp pulse to be applied during the reset period of the subsequent subfield according to the sustain discharge states of the previous subfield.

Further, an accurate reset operation can be performed by reducing the reset period of a subfield in which misfiring discharge is normally unlikely, and allocating the reduced time to the reset period of a subfield with a higher probability of misfiring discharge. Such a reallocation may be performed without increasing the time needed for the total reset operation.

What is claimed is:

1. A plasma display panel (PDP) capable of dividing a frame into a plurality of subfields to display gray scales, comprising:

a panel including a plurality of address electrodes and a plurality of first and second electrodes arranged to cross the address electrodes, a discharge cell being formed by an adjacent address electrode and the first and second electrodes;

a driver for applying a driving voltage to the address electrode and the first and second electrodes; and a controller for controlling the driver according to input image signals, wherein the controller comprises a subfield data generator for generating subfield data for showing ON/OFF states of the discharge cell in the subfields from the image signals, a subfield data allocator for generating address data for showing ON/OFF states of discharge cells per subfield from the subfield data, and a driving controller for counting a number of discharge cells that are ON from among the discharge cells from the address data of one subfield and controlling a waveform applied to a reset period of a subsequent subfield in accordance with the number of discharge cells that are ON.

2. The PDP of claim 1, wherein the driver applies a rising waveform (which rises from a start voltage to a final voltage) to the first electrode during the reset period; and the driving controller controls the start voltage of the rising waveform of the subsequent subfield according to the number of the discharge cells that are ON, and controls the rising time for the rising waveforms of a subsequent subfield to rise from the start voltage to the final voltage according to the number of the discharge cells that are ON.

3. The PDP of claim 1, wherein the driver applies a rising waveform (which rises from a start voltage to a final voltage) to the first electrode during the reset period of each subfield, and the driving controller controls the start voltage of the rising waveform of the subsequent subfield according to the number of the discharge cells that are ON.

4. The PDP of claim 2, wherein the driving controller reduces the start voltage of the rising waveform of the subsequent subfield by a predetermined voltage when the number of the discharge cells that are ON is greater than a reference number.

5. The PDP of claim 2, wherein the driving controller increases the start voltage of the rising waveform of the subsequent subfield by a predetermined voltage when the number of the discharge cells that are ON is less than a reference number.

6. The PDP of claim 1, wherein the driver applies a rising waveform (which rises from a start voltage to a final voltage) to the first electrode during the reset period of each subfield, and the driving controller controls a rising time for the rising waveform of a subsequent subfield to rise from the start voltage to the final voltage according to the number of the discharge cells that are ON.

7. The PDP of claim 2, wherein the driving controller increases the rising time of the rising waveform of the subsequent subfield when the number of the discharge cells that are ON is greater than a reference number.

8. The PDP of claim 7, wherein the driving controller decreases the rising time of the rising waveform of the subsequent subfield when the number of the discharge cells that are ON is less than a reference number.

9. The PDP of claim 1, wherein the driver applies a falling waveform (which falls from a start voltage to a final voltage) to the first electrode during the reset period of each subfield, and the driving controller controls a falling time for the falling waveform of a subsequent subfield to fall from the start voltage to the final voltage according to the number of the discharge cells that are ON.

10. The PDP of claim 9, wherein the driving controller increases the falling time of the falling waveform of the subsequent subfield when the number of the discharge cells that are ON is greater than a reference number.

11. The PDP of claim 9, wherein the driving controller decreases the falling time of the falling waveform of the subsequent subfield when the number of the discharge cells that are ON is less than a the reference number.

12. The PDP of claim 9, wherein the falling waveform repeatedly reduces the voltage and floats the same.

13. The PDP of claim 12, wherein the driving controller controls the magnitude of the reduced voltage, and controls the falling time of the falling waveform.

14. The PDP of claim 12, wherein the driving controller controls the floating time, and controls the falling time of the falling waveform.

15. The PDP of claim 1, wherein the controller further comprises a frame memory for storing the subfield data per frame and the address data.

16. A method for driving a plasma display panel (PDP) including a plurality of address electrodes and a plurality of first and second electrodes crossing the address electrodes, comprising:

generating subfield data for showing ON/OFF states of discharge cells from among subfields from input image signals;

generating address data for showing ON/OFF states of the discharge cells for each subfield from the subfield data; and determining a number of discharge cells that are ON from among the discharge cells from the address data, and controlling a waveform applied during a reset period of a subsequent subfield in accordance with the number of discharge cells that are ON.

17. The method of claim 16, wherein the step of determining the number of discharge cells further comprises reducing an initial voltage of a rising waveform applied during a reset period of the subsequent subfield by a predetermined voltage when the number of the discharge cells that are ON is greater than a reference value, and increasing the initial voltage of the rising waveform applied during the reset period of the subsequent subfield by a predetermined voltage when the number of the discharge cells that are ON is less than the reference value.

18. The method of claim 16, wherein the step of determining the number of discharge cells further comprises increasing the time for applying the rising waveform during the reset period of the subsequent subfield when the number of the discharge cells that are ON is greater than a reference value, and reducing the time for applying the rising waveform during the reset period of the subsequent subfield when the number of the discharge cells that are ON is less than the reference value.

19. The method of claim 16, wherein the step of determining the number of discharge cells further comprises: reducing the initial voltage of the rising waveform applied during the reset period of the subsequent subfield and increasing the time for applying the rising waveform when the number of the discharge cells that are ON is greater than a reference value, and increasing the initial voltage of the rising waveform applied during the reset period of the subsequent subfield and reducing the time for applying the rising waveform when the number of the discharge cells that are ON is less than the reference value.

20. The method of claim 16, wherein the step of determining the number of discharge cells further comprises increasing the time for applying a falling waveform during the reset period of the subsequent subfield when the number of the discharge cells that are ON is greater than a reference value, and reducing the time for applying a falling waveform during the reset period of the subsequent subfield when the number of the discharge cells that are ON is less than the reference value.

21. The method of claim 18, wherein the falling waveform repeatedly reduces the voltage and floats the same, and the magnitude of the reduced voltage or the floating time is controlled to control the falling time of the falling waveform.

* * * * *